United States Patent [19]

Leckey et al.

[11] Patent Number: 4,758,722

[45] **Date of Patent: * Jul. 19, 1988**

[54] ANGULAR RESOLVED SPECTROMETER

[75] Inventors: Robert C. G. Leckey; John D. Riley, both of Victoria, Australia

[73] Assignee: La Trobe University, Victoria, Australia

[ * ] Notice: The portion of the term of this patent subsequent to Jun. 19, 2003 has been disclaimed.

[21] Appl. No.: 615,445

[22] Filed: May 30, 1988

Related U.S. Application Data

[63] Continuation-in-part of Ser. No. 336,346, filed as PCT AU81/00053, May 8, 1981, published as WO81/03395, Nov. 26, 1981, abandoned.

[30] Foreign Application Priority Data

May 12, 1980 [AU] Australia ..... PE3501
May 8, 1981 [EP] PCT I'ntl Appl. ..... PCT/AU81/00053

[51] Int. Cl.[4] ..... H01J 49/48

[52] U.S. Cl. ..... 250/305; 250/396 R; 250/397

[58] Field of Search ..... 250/305, 309, 396 R, 250/397

[56] References Cited

U.S. PATENT DOCUMENTS 3,742,214 6/1973 Helmer et al. ..... 250/305

FOREIGN PATENT DOCUMENTS 3008273 9/1981 Fed. Rep. of Germany .
WO81/03395 11/1981 World Int. Prop. O. .

OTHER PUBLICATIONS

Jost, K., "Novel Design of a 'Spherical' Electron Spectrometer", *Jour. Phys. E. Sci. Instruments,* vol. 12, No. 10, Oct. 1979.

"A 304 Å Photoelectron Spectrometer for Band Structure Studies", by Poole et al., in *Vacuum,* vol. 22, No. 10.

"A Soft X-Ray Source for Photoelectron Spectroscopy", by McLachlan et al. in *Rev. Sci. Instrum.,* vol. 44, No. 7, Jul. 1973.

"A Novel Momentum-Resolving Multichanneling Electron and Ion Spectrometer", by Engelhardt et al., in the *Proceedings of the Fourth International Conference on Solid Surfaces and the Third European Conference on Surface Science,* vol. 2, Sep. 22-26, 1980.

(List continued on next page.)

*Primary Examiner*—Bruce C. Anderson
*Assistant Examiner*—T. W. Grigsby
*Attorney, Agent, or Firm*—Armstrong, Nikaido, Marmelstein & Kubovcik

[57] ABSTRACT

An angular resolved spectrometer is provided which is capable of analyzing the energy of charged particles from an analysis source and simultaneouosly obtaining spectra with a resolution of $\pm 1.0°$ for a range of angles of emission up to an order of 340° in a single selected plane of emission. Concentric toroidal electrode sectors move charged particles with emission angles $-\alpha_o \leqq \alpha \leqq +\alpha_o$, any $\beta$ angle, and a chosen energy, entering at a path midway of the inlet end of an open-ended annular toroidal-contoured passageway formed by said concentric toroidal sectors and between which an electrical field is arranged in operation to be established, so that charged particles with said energy and angles $(\alpha,\beta)$ will be refocused such that those charged particles with differing $\alpha$ angles are strongly refocused but those charged particles with differing $\beta$ angles are only weakly refocused, thereby to retain the required $\beta$ angular information at the $\alpha$ focus plane and provide a focus of charged particles into ring form. A charged particles position-sensitive detector then registers the focus of charged particles in ring form and generates signal pulses determined by the position of arrival of the charged particles on the detector. Means which measures differences in arrival times of the signal pulses is preferably employed to determine the angle $\beta$ at which the charged particles were emitted from said analysis source.

13 Claims, 3 Drawing Sheets

OTHER PUBLICATIONS

"Novel Charged Particle Analyzer for Momentum Determination in the Multichanneling Mode: I. Design Aspects and Electron/Ion Optical Properties", by Engelhardt et al., in *Rev. Sci. Instrum.* 52(6), Jun. 1981.

"Novel Charged Particle Analyzer for Momentum Determination in the Multichanneling Mode: II. Physical Realization, Performance Tests, and Sample Spectra", by Engelhardt et al., in *Rev. Sci. Instrum.* 52(8), Aug. 19, 1981.

"Position-Sensitive Detector System for Angle-Resolved Electron Spectroscopy with a Cylindrical Mirror Analyzer", by Van Hoof et al. in *J. Phys. E. Scil. Instrum.*, vol. 13, 1980, pp. 409-414.

"Vidicon-Camera Parallel-Detection System for Angle-Resolved Electron Spectroscopy", by Weeks et al., in *Rev. Sci. Instrum.*, vol. 50, 1979, pp. 1249-1255.

"An Electron Spectrometer for Measuring both Angular and Energy Distributions of Photoemitted Electrons", in *Rev. Sci. Instrum.*, vol. 45, No. 10, Oct. 1974, pp. 12-3-1207, article by Pauty et al.

"An Ellipsoidal Mirror Display Analyzer System for Electron Energy and Angular Measurements", by Eastman et al., in *Nuclear Inst. and Meth.*, vol. 1/2 (1980), pp. 327-336.

"Microchannel Plate Detectors", by Joseph Ladislas Wiza, in *Nucl. Inst. and Meths.*, vol. 162, 1979, pp. 587-601.

"High Resolution Position-Sensitive Detectors Using Microchannel Plates", in *Nucl. Inst. and Meths.*, vol. 121 (1974), pp. 151-159.

ANGULAR RESOLVED SPECTROMETER

BACKGROUND OF THE INVENTION

This application is a continuation-in-part of application Ser. No. 336,346 filed as PCT AU81/00053, May 8, 1981, published as WO81/03395, Nov. 26, 1981, now abandoned. This invention provides a charged particle energy analyser of the electrostatic type having the capability of accepting charged particles emitted by a source over a wide range of angles in such a manner that the angle of emission of an individual charged particle may be determined from its position of arrival at a position-sensitive detector.

In many forms of spectroscopy involving the detection of charged particles, such as electrons or ions, which have been ejected from some source, such as gases or solids, it is necessary to determine the energy distribution of the charged particles. Numerous energy analysers have been described in the literature which are capable of determining the number of charged particles accepted into the analyser as a function of the kinetic energy of the particles, vide: K. D. Sevier, "Low Energy Electron Spectrometry", published by Wiley, N.Y., 1972. Such analysers may be categorized in two ways for the purposes of describing the instrument of the present invention: (a) by their use of electrostatic or magnetic fields as the means whereby charged particles are accepted or rejected on the basis of their energies, and (b) by the angular acceptance capability of each analyser. As an example of a spectroscopy using electrostatic analysers, photoelectron spectroscopy will be used.

Solid state photoelectron spectroscopy involves the energy analysis of electrons emitted from solids when monochromatic photons impinge on them. The usual photon energies used are the Alkα X-ray line of 1486.6 eV or the noble gas discharge lines of He at 21.22 eV or 40.81 eV. More recently continuum synchrotron radiation sources have been used in conjunction with monochromators so that photons of any chosen energy may be employed. The most usual form of analyser presently used is a parallel plate capacitor shaped in such a way that only electrons of a single energy arrive at the detector. The two most preferred designs are concentric hemispherical plates or concentric cylinders. These are said to be double focusing which means that electrons of the same energy will arrive at the focus point even if they diverge from the main path in either of two perpendicular planes.

Photoelectrons are emitted from solid surfaces when illuminated with light, for example, UV ~304 Å or 584 Å. The electrons have energies and momenta which can be related to their initial states in the solids. The angles at which electrons are emitted from the surface of single crystal samples depend upon the initial state of the electron within the solid. By measuring the angular distribution (energy and angle of emission) of the photoelectrons, the full energy-momentum states (band structure) of the material can be determined. This is currently providing the most direct experimental link with theoretical calculations of electron states in solids, and provides experimental confirmation or criticism of the extensive theoretical literature.

Angular resolved spectrometers are currently commercially available. The analyser used has an acceptance cone limited by slits to the required angular resolution, approximately ±2°, and is usually mounted on a rotatable plate so that electrons leaving the surface at different angles can be measured successively. A single crystal sample is mounted in a known orientation in the spectrometer, and the analyser set at known angles to the crystal axis and rotated around the specimen to determine the energy spectrum at each setting.

A spectrum of counts against energy taken from ±90° from the crystal surface normal in steps of 2.5° for a maximum of 73 different positions, typically requires about 30 minutes at each position for He 21.22 eV photons. Also, there are attendant problems of surface cleanliness as the surface of the crystal adsorbs gas atoms from the vacuum, which progressively degrades the spectrum in a few hours. Further, because of variations of light intensity, it is difficult to relate precisely the intensity of individual spectra.

SUMMARY OF THE INVENTION

The object of the present invention is to provide an angular resolved spectrometer capable of analysing the energy of charged particles emitted from an analysis source and simultaneously obtaining spectra with a resolution of ±1.0° for a range of angles of emission up to an order of 340° in a single selected plane of emission, without the necessity of rotating the analyser. This minimizes the analysis time and thereby avoids the problem of maintaining surface cleanliness over a long period, besides enabling a direct comparison of individual spectra.

An angular resolved spectrometer according to the present invention comprises: (I) an angle-defining electrode which has a principal axis on which the analysis source is to be mounted in the spectrometer and having an aperture which defines the said selected emission plane for the analysis source as well as a spread of angles $\alpha$ between $+\alpha_o$ and $-\alpha_o$ of particle trajectories on either side of the selected plane of emission to be accepted by the spectrometer, charged particles being emitted from the analysis source along particle trajectories characterised by angular coordinates designated $\alpha,\beta$, wherein $\alpha$ defines an angular deviation away from the plane of emission and $\beta$ defines a particular direction in the plane of emission; (II) concentric toroidal electrode sectors spaced apart to form an open-ended toroidal-contoured passageway defined by opposed surfaces of said concentric toroidal sectors and between which an electrical field is arranged to be established, said electrical field in operation being such that charged particles of a chosen energy and whose trajectories on passing through the aperture of said angle-defining electrode and entering an inlet end of the passageway between said toroidal electrode sectors at the mid point of said inlet end of said passage way, lie within chosen angular bounds $-\alpha_o \leqq \alpha \leqq +\alpha_o$ but have any available value of the angle $\beta$, will be refocused in relation to the angle $\alpha$ on leaving an outlet end of the passage way, while remaining substantially undeflected in relation to the angle $\beta$ associated with each trajectory, thereby to retain the required $\beta$ angular information at the $\alpha$ focus plane and to provide a focus of charged particles into ring form; and (III) a charged-particle, position-sensitive detector which registers the focus of charged particles emitted in ring form from the outlet end of said passageway and generates signal pulses determined by the position of arrival of the charged particles on said detector, whereby the angle $\beta$ in said plane of emission can be measured.

More particularly, the angular resolved spectrometer of the invention comprises in axial alignment: (A) a charged particles input focusing section embodying a slitted electrode the slit of which has a principal axis on which the analysis source is to be mounted in the spectrometer and defines said selected emission plane for the analysis source as well as a spread of angles $\alpha$ between $+\alpha_o$ and $-\alpha_o$ of particle trajectories on either side of the selected plane of emission to be accepted by the spectrometer, charged particles being emitted from the analysis source along particle trajectories characterized by angular coordinates designated $\alpha,\beta$, wherein $\alpha$ defines an angular deviation away from the plane of emission and $\beta$ defines a particular direction in the plane of emission; (B) an energy resolving electrode section embodying concentric toroidal electrode sectors spaced apart to form an open-ended toroidal-contoured passageway defined by opposed surfaces of said concentric toroidal sectors and between which an electrical field is arranged to be established, said electrical field in operation being such that charged particles of a chosen energy and whose trajectories on passing through the slit and entering an inlet end of the passageway between said toroidal electrode sectors at the mid point of said inlet end of said passageway, lie within chosen angular bounds $-\alpha_o \leqq \alpha \leqq +\alpha_o$ but have any available value of the angle $\beta$, will be refocused in relation to the angle $\alpha$ on leaving an oulet end of the passageway, while remaining substantially undeflected in relation to the angle $\beta$ associated with each trajectory, thereby to retain the required $\beta$ angular information at the $\alpha$ focus plane and to provide a primary focus of charged particles into ring form; (C) a charged-particles output focusing section embodying a slitted electrode which defines the focal plane of the charged particles emitted from the outlet end of said passageway and provides a secondary focus of charged particles into ring form; and (D) a charged-particles registering section embodying a charged-particles, position-sensitive detector which registers the focus of charged particles emitted in ring form from the charged-particles output focusing section and generates signal pulses determined by the position of arrival of the charged particles on said detector, whereby the angle $\beta$ in said plane of emission can be measured.

By virtue of the toroidal geometry of the energy resolving electrode section, charged particles can be accepted into the spectrometer for analysing sensibly all angles $\beta<360°$, however, only those charged particles emitted from the analysis source into a cone of half angle $\alpha_o$ about said plane of emission will be accepted ($\alpha_o \approx 2°$). Thus, charged particles of chosen energy are refocused onto the charged particles position-sensitive detector for those particles originally within the acceptance cone defined by $\alpha_o$, but there is sensibly no focusing in terms of the angle $\beta$. Stated in another way, there is one-to-one correspondence between the emission of charged particles at a particular angle $\beta_1$ and a range of angles $-\alpha_o \leqq \alpha \leqq +\alpha_o$, and the arrival of that fraction of such particles as was emitted with a selected value of kinetic energy, at a unique point on the detector. For an analysis source which emits charged particles for all angles $0<\beta<360°$, such particles as have the correct emission energy will be refocused as an annular (circular) pattern on the detector.

Means for measurement of difference in arrival times of the signal pulses is preferably employed to determine the angle $\beta$ at which the charged particles were emitted from said analysis source. Signal pulses generated by the charged particles refocused as an annular pattern on the detector can be electronically processed in any suitable manner to provide data as a function of energy at a particular angle. Thus, the signal pulses can be processed into digitized time differences and loaded into the histogram memory of a control computer so that it contains counts as a function of angle for one particular energy, then reorganized in the data memory to give counts as a function of energy at a particular angle, with repeats until satisfactory statistics have been obtained.

PREFERRED EMBODIMENT OF THE INVENTION

In a preferred embodiment of the invention, the spectrometer comprises five major sections as follows:

1: A charged particles input focusing section consisting of a set of cylindrically symmetric slitted electrodes having a principal axis on which the analysis source is to be located, the slit of the first of which lies in said selected plane of emission defines the angle $\alpha$ and the slits of the remainder of which refocus all charged particles emitted from the analysis source of a chosen energy and with emission angles $-\alpha_o \leqq \alpha \leqq +\alpha_o$ and any angle $\beta$ in said plane of emission, entering at the mid point of the inlet end of said toroidal-contoured passageway defined by the opposed surfaces of said concentric toroidal sectors. By varying the voltages applied to this input lens of electrodes, charged particles of various energy can be brought to a focus at the inlet end of said toroidal-contoured passageway. This input lens has been designed using the data disclosed by E. Harting and F. H. Read, "Electrostatic Lenses", published by Elsevier, Amsterdam, 1976, which is applicable for planar aperture lenses, as the first approximation for the design of the present cylindrical elements, the design being finalized using numerical analysis based on a relaxation procedure, vide: T. Mulvey and M. J. Wallington, Reports on Progress in Physics, 36, 347–431, 1973.

2: An energy resolving section consisting of two concentric sectors of toroids spaced-apart so that their opposed surfaces define the toroidal-contoured passageway and between which surfaces the electrical field is arranged to be established. Charged particles from the charged particles input focusing section with an energy $E_p$ entering said electrical field at the mid point of the inlet end of said passageway defined by said concentric toroidal sectors and essentially perpendicular to the radial direction of the electrical field lines will move in an almost circular path of radius $a_o$ equidistant from each toroidal surface if the electrical potentials on each toroidal sector with radii $r_1$, $r_2$ are:

$$V(r_1,r_2) = \frac{2E_p}{\pi R}(2a_o + \pi R)\ln\left[\frac{a_o(2r_{1,2} + \pi R)}{r_{1,2}(2a_o + \pi R)}\right]$$

where $V(r_1,r_2)$ is the voltage on an electrode of radius $r_1$ or $r_2$, $E_p$ is the required pass energy of the analyser in electron volts, $a_o$ is the radius of the main path, R is the radius of rotation of the generating circle of the toroid, and $r_1$ and $r_2$ are the radii of the generating circles of the toroidal electrodes. Charged particles with the above energy $E_p$ which deviate in angle ($\alpha$) from the perpendicular entry path and for any angle $\beta$, where $\alpha$ is the angle of deviation in a plane containing the axis of the spectrometer and $\beta$ is an angle in a plane perpendicular to the axis, will be refocused by the toroidal energy resolving section. An intermediate focus having been established by the input lens system near the entrance to the toroidal section, this section then strongly refocuses those charged particles with differing $\alpha$ angles but only weakly refocuses charged particles with differing $\beta$ angles, thereby retaining the required $\beta$ angular information at the $\alpha$ focus plane.

3: A charged particles output focusing section consisting of a set of slitted electrodes of frusto-conical symmetry and comprising: (i) a second focal plane electrode which serves to define the output slit size, and (ii) a two element accelerating lens system for the charged particles.

The $\alpha$ focal points of the toroidal section lie on a circle defined by a slit in said focal plane electrode. The position of the $\alpha$ focus is calculated to a first approximation using Wollnick's general theory of analysers, vide: H. Wollnick, "Focusing of Charged Particles", ed. A. Septier, Vol II, published by Academic Press, N.Y., 1967. This depends on the toroid sector angle $\theta$, the radii of the toroidal sections, and the generating radius of the toroids R. The energy resolving power depends on all radii and on the sizes of the input and the output slits of the analyser.

The two-element accelerating lens system, shaped as frusto-conical sections, functions to accelerate the charged particles to a suitable energy (300–500V) for transfer of the ring-form focus of charged particles to the position-sensitive detector. This lens system is designed using the normal criteria for slit lenses (Harting and Read, supra) as a first approximation and incorporate adjustments allowing for the actual lens geometry being conical.

4: A microchannel amplifier plate (Galileo model 3040-B) which under electrical potential amplifies the charge delivered by each incident charged particle by a factor of $\sim 10^6$ and ejects the charge for registering on the charged particles position-sensitive detector.

5: A charged particles position-sensitive detector which is arranged to be at a higher electrical potential than the exit potential of the microchannel amplifier plate and is disposed below the microchannel amplifier plate to receive the amplified pulses ejected onto the detector.

The detector follows the usual technology for position-sensitive detectors but is of novel geometry, that is, it is different from other configurations in that as the final analyser focus is a ring, the detector is in strip-form and in the shape of a section of an annulus from whose ends the signal pulses are derived. The detector preferably consists of a plate containing a plurality of separate annular resistive strips, say, four, though only one of these is used at any time. The remaining strips may be brought into use by adjusting the vertical position of the microchannel amplifier plate and detector plate in the event of damage occurring to a particular part of the microchannel amplifier plate.

In the preferred practical form, the detector consists of a thin ceramic plate (0.6 mm thick) coated on the top side with one or more resistive coatings to which sensing electrodes are attached and on the bottom side with a conducting layer which is earthed.

The detector plate acts as a distributed RC delay line and when a charge pulse strikes the detector strip at a given point, a charge flows to both ends of the detector strip. The arrival time of each pulse at the ends of the detector strip depends on the distance travelled so that by measuring the difference in arrival times, the position of arrival of the charge on the annular strip can be determined, vide: E. Mathieson, K. D. Evans, W. Parkes and P. F. Christie, Nuclear Instruments and Methods 121, 139–149 (1974), hence the angle at which the charged particles were emitted from the analysis source can be determined.

Electronic processing of the charges arriving on the detector plate strip can be of usual form as illustrated in FIG. 5 of the drawings. The pulses are amplified and fed to timing single channel analysers. One pulse, the stop pulse, is delayed by the total transit time of the detector strip ($\sim 1\mu$ sec) so that it always arrives at the time to digital converter after the start pulse. Each digitized time difference is then a register address in a histogram memory of the control computer (LeCroy 3500) and causes that register to be incremented by 1.

The histogram memory will thus contain counts as a function of angle for one particular energy. The complete set of spectra are obtained by stepping the energy of the analyser, usually by Varying input lens voltages. Thus at the end of each energy step, the histogram memory data is reorganised in the data memory to give counts as a function of energy at a particular angle. This process is repeated until satisfactory statistics have been obtained.

A major field of application of the analyser of the present invention is in photoelectron spectroscopy, and the foregoing description is largely based on such an application. As indicated above, however, the analyser can be used in many other forms of electron or ion spectroscopy and the description in terms of the photoelectron technique is for illustrative purposes only. In particular, the foregoing description largely relates to photoelectron spectroscopy using solid samples but it will be understood that the description could equally well be given in terms of the spectroscopy of gaseous samples.

PRACTICAL EMBODIMENT OF THE INVENTION

A practical embodiment of a spectrometer in accordance with the present invention is illustrated in the accompanying drawings, in which:

FIG. 1 is a diagrammatic illustration of the sample region of an angular resolved photoelectron spectrometer, the z axis being perpendicular to the crystal layers of the sample, the plane z=0 defining the crystal surface.

FIG. 2 is a diagrammatic perspective view of concentrically arranged, substantially hemi-spherical, toroidal electrode sectors and an annular detector plate, a portion of the toroidal electrode sectors being cut-away to show their configuration in cross-section, in defining the toroidal-contoured passageway or pathway for deflecting charged particles (indicated by arrows) from a sample via entrance slits in tubular electrodes (not shown), and also to show an axial passage defined by the toroidal electrode sectors for accommodating the tubular electrode, with frusto-conical electrodes (not shown) located in the space between the toroidal electrode sectors and the annular detector plate.

Figure 1:
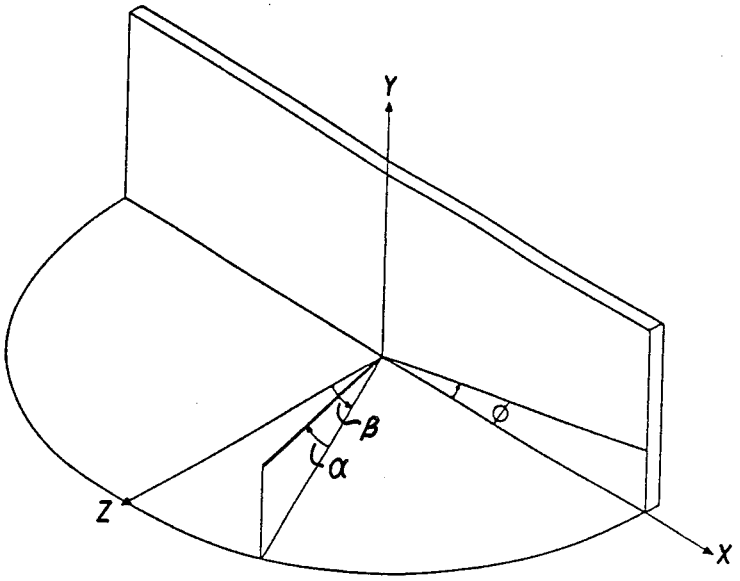
Figure 2:
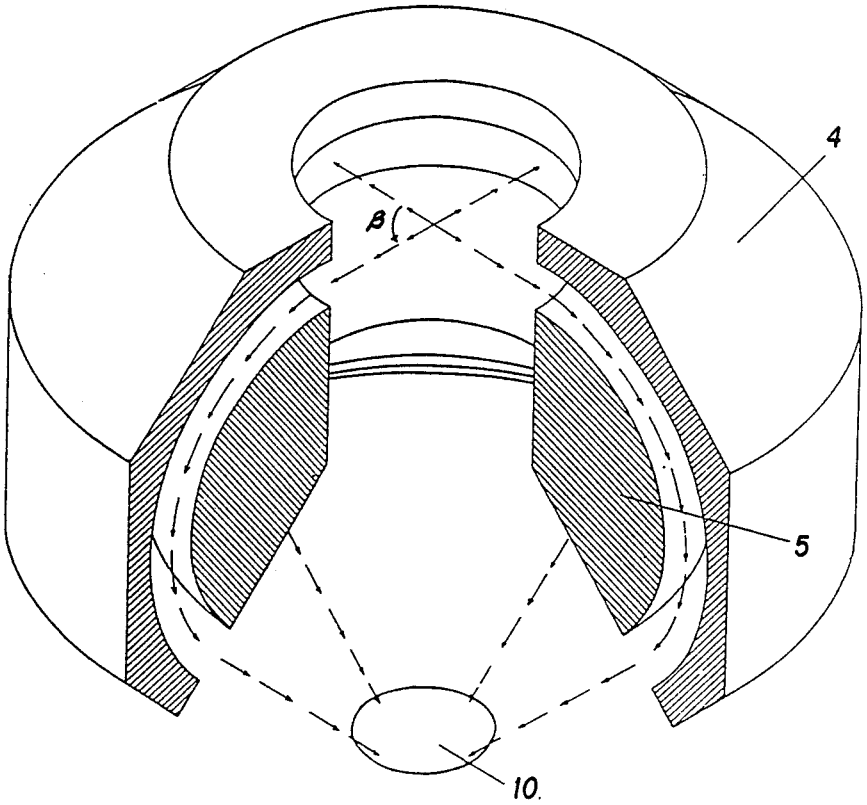

Referring to FIG. 1, in a typical photoelectron experiment the intensity of electron emission as a function of electron energy, polar angle of emission $\beta$ and azimuthal angle $\phi$ is to be measured. In conventional angle resolved spectrometers, data is acquired for each selected combination of $\beta$ and $\phi$ successively, the energy analyser being capable of accepting electrons emitted with a range $-\alpha_o \leqq \alpha \leqq +\alpha_o$. In the spectrometer of the present invention, for a chosen value of $\phi$, all electrons within the range $0<\beta<340°$ and $-\alpha_o \leqq \alpha \leqq +\alpha_o$ are accepted into the energy analyser, thereby decreasing the total time required to analyse the emission from a selected crystal surface.

In indicating the sample surface as the X-Y plane, it can be noted that in the context $Z=0$, $\beta=0$ implies emission perpendicular to the sample surface and $\alpha=0$ implies emission in a plane perpendicular to the sample surface which includes the Z axis; that this is consequently the plane of emission even though the spectrometer of the invention accepts particles which deviate by at most $\pm\alpha_o$ degrees from this plane; and that $\beta$ is thus properly a polar angle with reference to the co-ordinate axes as shown in FIG. 1 and $\phi$ is properly an azimuthal angle in this sense.

Figure 3:
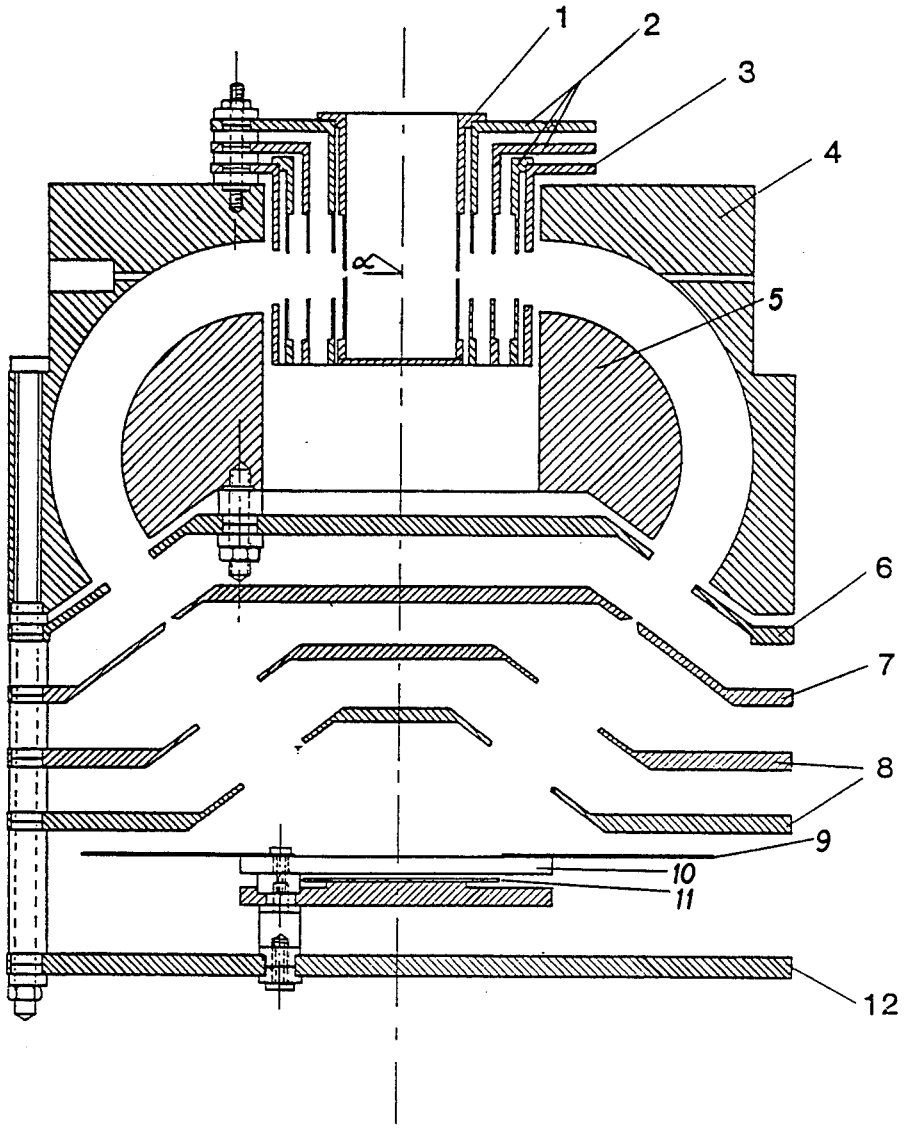
FIG. 3 is a diagrammatic cross-sectional view of the arrangement illustrated in FIG. 2 but showing the tubular electrode located in said axial passage defined by the substantially hemi-spherical toroidal electrode sectors and the conical electrodes located in said space between the toroidal electrode sectors and the annular detector plate.
Figure 4:
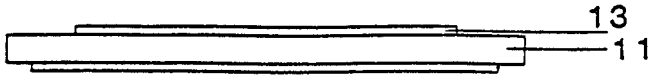
FIG. 4 is a diagrammatic side elevational view of the annular detector plate, the details of which are further illustrated in FIG. 5.

Referring to FIG. 3 of the drawings, the spectrometer will be seen to comprise an angular defining electrode 1; three slitted cylindrical electrodes 2, the electrode 3 providing a primary Herzog slit; the toroidal electrode sectors 4 and 5; electrode 6, which provides a secondary Herzog slit; an $\alpha$ focal plane plate 7; a two-element lens system 8 which refocuses the charged particles focus; an electrostatic shield plate 9; a multichannel amplifier plate 10; and an annular detector plate 11 on mounting plate 12.

The sample is supported with its surface along the axis of symmetry of the spectrometer. The three cylindrical electrodes 2 are located in the axial passage of the substantially hemi-spherical toroidal electrode sectors 4 and 5. Where a solid sample is involved, the range of $\beta$ will be at most $-90°<\beta<+90°$, whereas with a gaseous sample the range $-160°<\beta<+160°$ is possible.

In indicating the sample supported with its surface along the axis of symmetry of the spectrometer, it can be noted that in the context the emission plane is thus horizontal, the various $\beta$ angles being out of the plane of FIG. 3 ($\beta \neq 0$); that the plane associated with the entrance slit is the $\alpha=0$ plane for all $\beta$, the particles from a solid sample being emitted into the half-space $-90<\beta<+90$: $-90<\alpha<+90$ but only those with $-\alpha_o \leqq \alpha \leqq +\alpha_o$ are accepted into the spectrometer; and that given the finite extent of the entrance slit 1, said slit 1 subtends an angle $\pm\alpha_o$ at the origin of co-ordinates (on sample surface).

The first electrode 1 defines the field-free region in which the analysis sample sits and its slit defines the angular resolution, the three element lens acting as a zoom lens focuses the electrons at the entrance to the toroidal sectors. Between electrodes 1 and 3 a retarding potential is applied which, in the usual operating mode of constant pass energy, is swept to obtain the energy spectra; the third electrode 3 which is called the Herzog slit, is usually held at ground potential and also correctly terminates the toroidal sector field.

Substantially hemi-spherical toroidal electrode sectors 4 and 5 which define a toroidal-contoured passageway or pathway for deflecting charged particles from the entrance slits by about 130°, have potentials applied relative to the potential of electrode 3, negative to the outer toroidal electrode sector 4 and positive to the inner toroidal electrode sector 5. Given the approximations made in the analysis of the analyser, the voltages for each of the toroidal electrode sectors 4 and 5 with radii $r_1$ and $r_2$ are:

$$V(r_1,r_2) = \frac{2E_p}{\pi R}(2a_o + \pi R)\ln\left[\frac{a_o(2r_{1,2} + \pi R)}{r_{1,2}(2a_o + \pi R)}\right]$$

where $V(r_1,r_2)$ is the voltage on an electrode of radius $r_1$ or $r_2$, $E_p$ is the required pass energy of the analyser in electron volts, $a_o$ is the radius of the main path, R is the radius of rotation of the generating circle of the toroid, and $r_1$ and $r_2$ are the radii of the generating circles of the toroidal electrodes. This creates an electric field whose equipotentials are approximately concentric circles and within which electrons of an appropriate energy (pass energy) are focused at the frusto-conical $\alpha$ focal plane electrode 7.

The frusto-conical electrodes 8, which are located in the space between the substantially hemi-spherical toroidal electrodes 4,5 and the multichannel amplifier plate 10, form a two-element lens system which refocuses electrons on the annular detector plate 11 via the multichannel amplifier plate 10. The electrons are refocused as an annulus for counting and analysing by an electronic computer.

Figure 5:
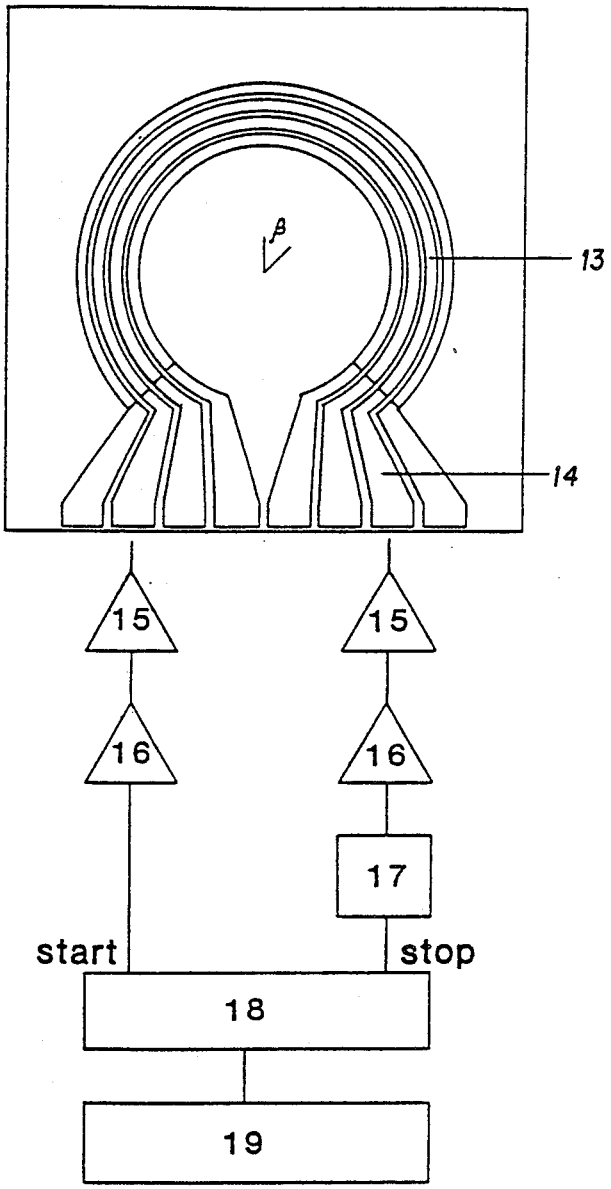
FIG. 5 is a schematic plan view illustrating the annular detector plate, which is of ceramic material carrying resistive strips on its upper face and is metallized on its lower face, the associated electronics which indicate the arrival of a pulse of charged particles and specify its arrival position on a resistive strip in terms of a digitized time interval measurement, being also shown.

Referring to FIG. 5, the upper face of ceramic plate 11 has annular strips of resistive material 13, the ends of each strip being terminated by conductive pads 14. The lower face of the ceramic plate is also coated with conductive material to complete the distributed RC delay line.

Following the arrival of a charge pulse from the microchannel amplifier plate 10 at some position on the chosen resistive strip 13, charge flows to output terminals at both ends of the strip 13 and is amplified by charge sensitive amplifiers 15. The amplified pulses are further shaped by timing single channel analysers 16 so as to be suitable as input pulses to a time to digital converter 18 (LeCroy 4201). An electronic delay 17 of approximately 1$\mu$ sec is introduced into one signal line to ensure that the pulse appearing at the 'start' input of the time to digital converter in all cases precedes the pulse appearing at the 'stop' input. The output of the time to digital converter is thus a binary coded signal describing the arrival position of the pulse incident on the detector plate. This signal is passed to the histogram data memory of the control computer 19 (LeCroy 3500 system) for further processing and storage.

What is claimed is:

1. An angular resolved spectrometer capable of analyzing the energy of charged particles emitted from an analysis source and simultaneously obtaining spectra with a resolution of $\pm 1°$ for a range of angles of emission up to approximately 340° in a single selected plane of emission, said spectrometer comprising:

(I) an angle-defining electrode which has an axis of symmetry which is normal to said single selected plane of emission and on which the analysis source is to be mounted in the spectrometer and having an aperture which defines the said selected emission plane for the analysis source as well as a spread of angles $\alpha$ between $+\alpha_o$ and $-\alpha_o$ of particle trajectories on either side of the selected plane of emission to be accepted by the spectrometer, charged particles being emitted from the analysis source along particle trajectories characterized by angular coordinates designated $\alpha,\beta$ wherein $\alpha$ defines an angular deviation away from the plane of emission and $\beta$ defines a particular direction in the plane of emission;

(II) concentric toroidal electrode sectors spaced apart to form an open-ended toroidal-contoured passageway defined by opposed surfaces of said concentric toroidal sectors and between which an electrical field can be established, said electrical field being such that charged particles of a particular energy and whose trajectories on passing through the aperture of said angle-defining electrode and entering an inlet end of the passageway between said toroidal electrode sectors at the mid point of said inlet end of said passageway lie within chosen angular bounds $-\alpha_o \leqq \alpha \leqq +\alpha_o$ but have any value of the angle $\beta$ within said range of angles of emission will be refocused in relation to the angle $\alpha$ on leaving an outlet end of the passageway while remaining substantially undeflected in relation to the angle $\beta$ associated with each trajectory, such that the required $\beta$ angular information is retained at an $\alpha$ focus plane and a focus of charged particles into ring form results; and (III) a charged-particles, position-sensitive detector means for determining the angle $\beta$ in said phase of emission by accepting charged particles focused at said $\alpha$ focus plane and registering their position of arrival in substantially focused form on said detector means to generate signal pulses such that the angle $\beta$ of the charged particles in said plane of emission can be determined by measurement of the signal pulses.

2. A spectrometer according to claim 1 further comprising means for determining the difference in arrival times at output terminals of said detector means of said signal pulses generated by said detector means.

3. A spectrometer according to claim 1 in combination with an electronic control computer means for determining and digitizing the difference in arrival times at output terminals of said detector means of the signal pulses corresponding to each charged particle, means for storing counts as a function of $\beta$ for a given value of said particular energy and means for storing counts as a function of $\beta$ for different values of energy.

4. An angular resolved spectrometer capable of analyzing the energy of charged particles emitted from an analysis source and simultaneously obtaining spectra with a resolution of $\pm 1°$ for a range of angles of emission up to approximately 340° in a single selected plane of emission, said spectrometer comprising in axial alignment:

(A) a charged particles input focusing section comprising a slitted electrode the slit of which has an axis of symmetry which is normal to said single selected plane of emission and on which the analysis source is to be mounted in the spectrometer and defines said selected emission plane for the analysis source as well as a spread of angles between $+\alpha_o$ and $-\alpha_o$ of particle trajectories on either side of the selected plane of emission to be accepted by the spectrometer, charged particles being emitted from the analysis source along particle trajectories characterized by angular coordinates designated $\alpha$, $\beta$ wherein $\alpha$ defines an angular deviation away from the plane of emission and $\beta$ defines a particular direction in the plane of emission;

(B) an energy resolving electrode section comprising concentric torodial electrode sectors spaced apart to form an open-ended torodial-contoured passageway defined by opposed surfaces of said concentric toroidal sectors and between which an electrical field can be established, said electrical field being such that charged particles of a particular energy and whose trajectories on passing through the slit and entering an inlet end of the passageway between said toroidal electrode sectors at the mid point of said inlet end of said passageway lie within chosen angular bounds $-\alpha_o \leqq \alpha \leqq +\alpha_o$ but have any value of the angle $\beta$ within said range of angles of emission will be refocused in relation to the angle $\alpha$ on leaving an outlet end of the passageway while remaining substantially undeflected in relation to angle $\beta$ associated with each trajectory, such that the required $\beta$ angular information is retained at an $\alpha$ focus plane such that a primary focus of charged particles into ring form results;

(C) a charged-particles output focusing section comprising a slitted electrode which defines the focal plane of the charged particles emitted from the outlet end of said passageway and a secondary focus of charged particles into ring form results; and (D) a charged-particles registering section comprising a charged-particles, position-sensitive detector means for determining the angle $\beta$ in said plane of emission by accepting charged particles focused at said $\alpha$ focus plane and registering their position of arrival in substantially focused form on said detector means to generate signal pulses such that the angle $\beta$ of the charged particles in said plane of emission can be determined by measurement of the signal pulses.

5. A spectrometer according to claim 4 wherein the charged-particles input focusing section consists of a set of cylindrically symmetric slitted electrodes having an axis of symmetry on which the analysis source is to be located, the slit of the first of said electrodes lying in said selected plane of emission and defining the angles $\alpha$ and the slits of the remainder of said electrodes refocusing all charged particles emitted from the analysis source at a particular energy and with emission angles $-\alpha_o \leqq \alpha \leqq +\alpha_o$ and any angle $\beta$ in said plane of emission, at the mid point of the inlet end of said toroidal-contoured passageway defined by the opposed surfaces of said concentric toroidal sectors, such that by varying voltages applied to said input lens of electrodes, charged particles of various energy can be brought to a focus at the inlet end of said toroidal-contoured passageway.

6. A spectrometer according to claim 4 wherein the energy resolving electrode section consists of two concentric sectors of toroids spaced-apart so that their opposed surfaces define the toroidal-contoured passageway and between which surfaces the electrical field can be established so that charged particles from the charged particles input focusing section with an energy $E_p$ entering said electrical field at the mid point of the inlet end of said passageway defined by said concentric torodial sectors and essentially perpendicular to the radial direction of said electrical field lines will move in an almost circular path of radius $a_o$ equidistant from each torodial surface if the electrical potentials on each toroidal sector with radii $r_1$, $r_2$ are:

$$V(r_1,R_2) = \frac{2E_p}{\pi R}(2a_o + \pi R)\ln\left[\frac{a_o(2r_{1,2} + \pi R)}{r_{1,2}(2a_o + \pi R)}\right]$$

where $V(r_1,r_2)$ is the voltage on an electrode of radius $r_1$ or $r_2$, $E_p$ is the required pass energy of the analyzer in electron volts, $a_o$ is the radius of the main path, R is the radius of rotation of the generating circle of the toroid, and $r_1$ and $r_2$ are the radii of the generating circles of the toroidal electrodes, such that charged particles with the energy $E_p$ which deviate in angle ($\alpha$) from the perpendicular entry path, and for any angle $\beta$, where $\alpha$ is the angle of deviation in a plane containing said axis of symmetry which is the axis of the spectrometer and $\beta$ is an angle in a plane perpendicular to said axis of symmetry, are strongly refocused with respect to $\alpha$ substantially independently of their values of $\beta$, such that the required $\beta$ angular information at the $\alpha$ plane is retained.

7. A spectrometer according to claim 4 wherein the charged particles output focusing section consists of a set of frusto-conical symmetry slitted electrodes comprising (i) a second focal plane electrode which defines the output slit size, and (ii) a two element lens system for accelerating the charged particles to an energy in the range of 300 to 500 volts for transfer of the ring-form focus of charged particles to the charged particles position-sensitive detector means.

8. A spectrometer according to claim 4 wherein the charged particles position-sensitive detector means consists of a detector plate comprising one or more charge-detecting strips in the shape of a section of an annulus from whose ends the signal pulses are derived.

9. A spectrometer according to claim 4 wherein the charged particles position-sensitive detector means consists of a thin ceramic plate coated on the upper side with one or more separate annular resistive strips to which sensing electrodes are attached and on a lower side with a conducting layer which is earthed.

10. A spectrometer according to claim 4 in combination with an electronic control computer means for determining and digitizing the difference in arrival times at output terminals of said detector means of the signal pulses corresponding to each charged particle, means for storing counts as a function of $\beta$ for a given value of said particular energy and means for storing counts as a function of $\beta$ for different values of energy.

11. A spectrometer according to claim 4, further comprising means for determining the diffrence in arrival times at output terminals of said detector means of said signal pulses generated by said detector means such that said difference in arrival times is a measure of the angle $\beta$.

12. A spectrometer according to claim 4 wherein a charged particles microchannel amplifier plate means for amplifying the charge delivered by each independent charged particle by a factor of about one million and ejecting the resulting charge for registering on the charged particles position detector means is interposed between the charged particles output section and the charged particles position-sensitive detector means.

13. A spectrometer according to claim 12 wherein the charged particles position-sensitive detector means in operation is at a higher electrical potential than the exit potential of the microchannel amplifier plate means and is disposed below the microchannel amplifier plate means to receive the amplified pulses ejected by the microchannel amplifier plate means for registering on said detector means.

* * * * *